US009639064B2

(12) United States Patent
Schneider

(10) Patent No.: US 9,639,064 B2
(45) Date of Patent: May 2, 2017

(54) WEARABLE ELECTRONIC DEVICE WITH HAND SYNCHRONIZATION

(71) Applicant: Timex Group USA, Inc., Middlebury, CT (US)

(72) Inventor: Stephanie Schneider, Pforzheim (DE)

(73) Assignee: Timex Group USA, Inc., Middlebury, CT (US)

( * ) Notice: Subject to any disclaimer, the term of this patent is extended or adjusted under 35 U.S.C. 154(b) by 0 days.

(21) Appl. No.: 14/858,261

(22) Filed: Sep. 18, 2015

(65) Prior Publication Data

US 2017/0082978 A1 Mar. 23, 2017

(51) Int. Cl.
*G04B 25/00* (2006.01)
*G04B 19/00* (2006.01)
(Continued)

(52) U.S. Cl.
CPC ..... *G04G 7/00* (2013.01); *G04B 19/00* (2013.01); *G04B 19/04* (2013.01); *G04B 19/23* (2013.01); *G04B 19/34* (2013.01); *G04G 9/00* (2013.01); *G04G 9/0082* (2013.01); *G04G 9/02* (2013.01); *G04G 9/027* (2013.01); *G04G 9/04* (2013.01); *G04G 9/047* (2013.01)

(58) Field of Classification Search
CPC ..... G04B 19/00; G04B 19/04; G04B 19/23; G04B 19/34; G04G 9/00; G04G 9/0082; G04G 9/02; G04G 9/027; G04G 9/047
USPC ..... 368/71, 223, 228, 238–242
See application file for complete search history.

(56) References Cited

U.S. PATENT DOCUMENTS 3,503,203 A * 3/1970 Gruner ..... G04B 13/008 368/21
4,212,159 A 7/1980 Noble et al.
(Continued)

FOREIGN PATENT DOCUMENTS

CN 202975617 6/2013
CN 103472708 12/2013
(Continued)

OTHER PUBLICATIONS

"Twincept Twin Sensor," Advertisement (Admitted Prior Art).
(Continued)

*Primary Examiner* — Amy Cohen Johnson
*Assistant Examiner* — Daniel Wicklund

(57) ABSTRACT

A wearable electronic device having an analog display and a digital display. The device may include a receiver for receiving, from a remote source, current time information data representative of a current time; a controller, operatively coupled to the receiver, wherein the controller processes the current time information data received from the remote source and provides for the current time information data to be displayed by the at least one digital indicator on the digital display as the current time; and a an analog time indicator rotating arrangement for causing the rotation of the at least one analog time indicator until the at least one analog time indicator is aligned with the at least one digital indicator; whereby the alignment of the at least one analog time indicator with the at least one digital indicator indicates that the at least one analog time indicator is synchronized with the correct time information.

13 Claims, 14 Drawing Sheets

(51) Int. Cl.

| | |
|---|---|
| ***G04B 19/04*** | (2006.01) |
| ***G04C 17/00*** | (2006.01) |
| ***G04C 17/02*** | (2006.01) |
| ***G04G 7/00*** | (2006.01) |
| ***G04G 9/02*** | (2006.01) |
| ***G04G 9/00*** | (2006.01) |
| ***G04G 9/04*** | (2006.01) |
| ***G04B 19/23*** | (2006.01) |
| ***G04B 19/34*** | (2006.01) |

(56) References Cited

U.S. PATENT DOCUMENTS

| | | | | |
|---|---|---|---|---|
| 4,254,490 | A | 3/1981 | Ganter | |
| 4,262,345 | A | 4/1981 | Ganter et al. | |
| 4,312,056 | A * | 1/1982 | Nishimura | G04G 9/087 368/21 |
| 4,335,453 | A * | 6/1982 | Fatton | G04G 9/0094 368/30 |
| 4,338,680 | A * | 7/1982 | Nomura | G04G 7/00 368/29 |
| 4,396,294 | A | 8/1983 | Yoshida | |
| 4,413,915 | A | 11/1983 | Besson | |
| 4,488,818 | A | 12/1984 | Saurer et al. | |
| 4,600,316 | A | 7/1986 | Besson | |
| 4,652,140 | A * | 3/1987 | Nakazawa | G04G 13/026 368/261 |
| 4,717,260 | A * | 1/1988 | Tsuji | G04B 19/223 368/21 |
| 5,251,190 | A * | 10/1993 | Miyasaka | G04G 21/02 368/10 |
| 5,479,379 | A * | 12/1995 | Tsuchiya | G04B 23/021 368/223 |
| 5,677,545 | A | 10/1997 | Shi et al. | |
| 5,694,376 | A * | 12/1997 | Sullivan | G04G 9/02 368/240 |
| 5,920,080 | A | 7/1999 | Jones | |
| 6,008,871 | A | 12/1999 | Okumura | |
| 6,072,752 | A | 6/2000 | Igarashi et al. | |
| 6,147,933 | A | 11/2000 | Bland | |
| 6,343,050 | B1 | 1/2002 | Kwok | |
| 6,449,219 | B1 | 9/2002 | Hepp et al. | |
| 6,515,942 | B2 | 2/2003 | Basturk | |
| 6,587,083 | B1 | 7/2003 | Basturk | |
| 6,600,527 | B1 | 7/2003 | Basturk | |
| 6,671,231 | B2 * | 12/2003 | Gilomen | G04G 9/0082 368/223 |
| 6,903,784 | B1 | 6/2005 | Basturk | |
| 6,967,901 | B2 | 11/2005 | Shimizu | |
| 7,646,678 | B2 | 1/2010 | Imai et al. | |
| 7,907,476 | B2 | 3/2011 | Lee | |
| 8,149,650 | B2 * | 4/2012 | Olsen | G04B 19/04 368/242 |
| 8,227,797 | B2 | 7/2012 | Seo | |
| 8,588,033 | B2 | 11/2013 | Pozzo Di Borgo et al. | |
| 8,861,314 | B1 * | 10/2014 | Arabian | G04B 19/04 368/223 |
| 8,976,631 | B2 * | 3/2015 | Umamoto | G04G 9/0064 368/11 |
| 9,310,780 | B2 * | 4/2016 | Essery | G04G 9/00 |
| 2006/0062089 | A1 * | 3/2006 | Lizzi | G04G 9/02 368/240 |
| 2006/0120220 | A1 | 6/2006 | Lai | |
| 2007/0043687 | A1 | 2/2007 | Bodart et al. | |
| 2008/0070533 | A1 * | 3/2008 | Kim | G04G 9/0082 368/82 |
| 2012/0201103 | A1 * | 8/2012 | Bakker | G04F 7/08 368/71 |
| 2013/0064045 | A1 | 3/2013 | Essery et al. | |
| 2013/0170324 | A1 | 7/2013 | Tu et al. | |
| 2013/0322217 | A1 | 12/2013 | Aizawa et al. | |
| 2013/0329530 | A1 * | 12/2013 | Johansson | G04C 17/00 368/29 |
| 2014/0133282 | A1 | 5/2014 | Hamm | |
| 2014/0247700 | A1 * | 9/2014 | Honda | G04G 9/0076 368/21 |

FOREIGN PATENT DOCUMENTS

| | | | |
|---|---|---|---|
| CN | 103605278 | 2/2014 | |
| CN | 203465525 | 3/2014 | |
| CN | 104035317 | 9/2014 | |
| CN | 104090483 | 10/2014 | |
| EP | 0926574 | 6/1999 | |
| JP | 58044383 A * | 3/1983 | |
| JP | 201438008 | 8/2012 | |
| JP | 201438007 | 2/2014 | |
| WO | WO 0171433 A1 * | 9/2001 | G04B 19/262 |
| WO | WO2006111481 | 4/2007 | |
| WO | WO2014121521 | 8/2014 | |

OTHER PUBLICATIONS

Casio Watch Video w/ publication date and screenshot, https://www.youtube.com/watch?v=XVDPLhM_Vy0 (Admitted Prior Art).

"Smart Mechanical/Quartz Watch Solution," Lonshine Technologies Co. (Admitted Prior Art).

"Engadget, an analog timepiece beats in the heart of this awkward smartwatch," https://www.engadget.com/2014/09/09/an-analog-timepiece-beats-in-the-heart-of-this-awkward-smartwatc/ (Admitted Prior Art).

"The Gadgeteer," Casio Twincept Review (Admitted Prior Art).

* cited by examiner

WEARABLE ELECTRONIC DEVICE WITH HAND SYNCHRONIZATION

BACKGROUND OF THE INVENTION

The present invention is directed to wearable electronic devices generally, and in particular, to a wearable electronic device that comprises an analog display for the display of time information by using one or more indicators (e.g. hands) and a digital display having one or more digital indicators for displaying at least current time on the digital display, wherein the digital display is used to facilitate synchronization of the indicators of the analog display.

Generally speaking, in many electronic analog watches of a first type, it is not always the case that the microcontroller "knows" precisely where the indicators (e.g. hour and/or minute hands) are positioned. Watches of this first type are generally quartz analog watches. An easy example of this perceived "problem" can be seen in watches of this first type where a user pulls out a mechanical crown to (e.g.) adjust the hands. From the time that the crown is pulled out and/or rotated so as to adjust the position of the hour and minute hands (i.e. adjusting the displayed time), the microcontroller no longer "knows" where the hands are. Thus, in conventional analog watches of this quartz analog type and construction, there can be no signaling, via an internal or external signal or the like, for the watch to move its hands to 3:00 p.m. from an initial position if the watch is not already accurately displaying the correct time at the time such instruction or signal is given. That is, for example, if the microcontroller "thinks" the hands are at 2:00 p.m. but were previously manually adjusted to 1:30 p.m., having the watch move the hands ahead one (1) hour to the perceived 3:00 p.m. would still leave the hands inaccurately positioned, i.e. they would be off the requested setting by ½ hour.

Said a bit differently, there is an important distinction between "time adjustment" and "hand synchronization," with examples of the former being more wide-spread in the prior art. That is, "time adjustment" may be accurate only if the indicator hands on the watch of this first type are positioned exactly where the microcontroller believes them to be (i.e. the indicator hands are indicating the correct time). In other words, the current state of the art does not adequately account for the situation when/if the microcontroller inside the watch of this first type believes the time is X but the actual position of the hands is indicating time Y (i.e. with X and Y being different times). In this latter situation, a "hand synchronization" in accordance with the present invention must be carried out so that the hands are synchronized to the correct time.

On the other hand, there are watches of a second type in which the indicator hands are always electronically coupled to the microcontroller, examples of which are known as "electroset" type watches. Such watches do not necessarily suffer from this perceived deficiency.

Analog radio controlled watches may be thought of as watches of yet a third type. Here the microcontroller "knows" where the hands are, and periodically, the watch's receiver may obtain local time. In such watches of this third type, hand position deviation can thus be periodically corrected. Such watches of this type may thus provide for synchronization between watch and the actual time.

Combination digital and analog watches are also known of the type illustrated in FIG. 14, although for obvious reasons, such watches are also unable to provide for the ease of hand synchronization as set forth herein.

While the present invention primarily concerns itself with synchronizing the hands of an analog display of a watch of the first type, the present invention is applicable to watches of these other types as would be understood in the art.

More specifically, it is believed that further advances to the state of the art are both desirable and achievable. In particular, it is desirable to provide watches with a hand synchronization functionality to more easily and accurately provide for accurate current time information and time adjustability on an analog display. It is also desirable to provide methodologies to carry out the foregoing functionality.

SUMMARY AND OBJECTIVES OF THE INVENTION

It is thus an objective of the present invention to overcome the perceived deficiencies in the prior art.

Specifically, it is an objective of the present invention to provide a user with a hand synchronization function in a wearable electronic device that permits for the synchronization of analog hands to an accurate time.

Still a further objective of the present invention is to provide methodologies for carrying out and/or facilitating the foregoing.

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

Therefore, to overcome the perceived deficiencies in the prior art and to achieve the objects and advantages set forth above and below, a preferred embodiment of the present invention is, generally speaking, directed to a wearable electronic device comprising (i) an analog display for the display of time information by at least one analog time indicator and (ii) a digital display having at least one digital indicator for displaying at least current time on the digital display; a receiver for receiving, from a remote source, current time information data representative of a current time; a controller, operatively coupled to the receiver, wherein the controller processes the current time information data received from the remote source and provides for the current time information data to be displayed by the at least one digital indicator on the digital display as the current time; an analog time indicator rotating arrangement for causing the rotation of the at least one analog time indicator until the at least one analog time indicator is aligned with the at least one digital indicator; whereby the alignment of the at least one analog time indicator with the at least one digital indicator indicates that the at least one analog time indicator is synchronized with the correct time information.

In another preferred embodiment, a wearable electronic device may comprise (i) an analog display for the display of time information by at least one analog time indicator and (ii) a digital display having at least one digital indicator for displaying at least current time on the digital display; a controller, wherein the controller maintains current time information and provides for the current time information to be displayed by the at least one digital indicator on the digital display as the current time; an analog time indicator rotating arrangement for causing the rotation of the at least one analog time indicator until the at least one analog time indicator is aligned with the at least one digital indicator;

whereby the alignment of the at least one analog time indicator with the at least one digital indicator indicates that the at least one analog time indicator is synchronized with the correct time information.

In a preferred embodiment, the electronic device is a timepiece in the form of a wristwatch.

BRIEF DESCRIPTION OF THE DRAWINGS

The above set forth and other features of the invention are made more apparent in the ensuing Description of the Preferred Embodiments when read in conjunction with the attached Drawings, wherein.

Identical reference numerals in the figures are intended to indicate like parts, although not every feature in every figure may be called out with a reference numeral.

DETAILED DESCRIPTION OF THE PREFERRED EMBODIMENTS

Figure 1:
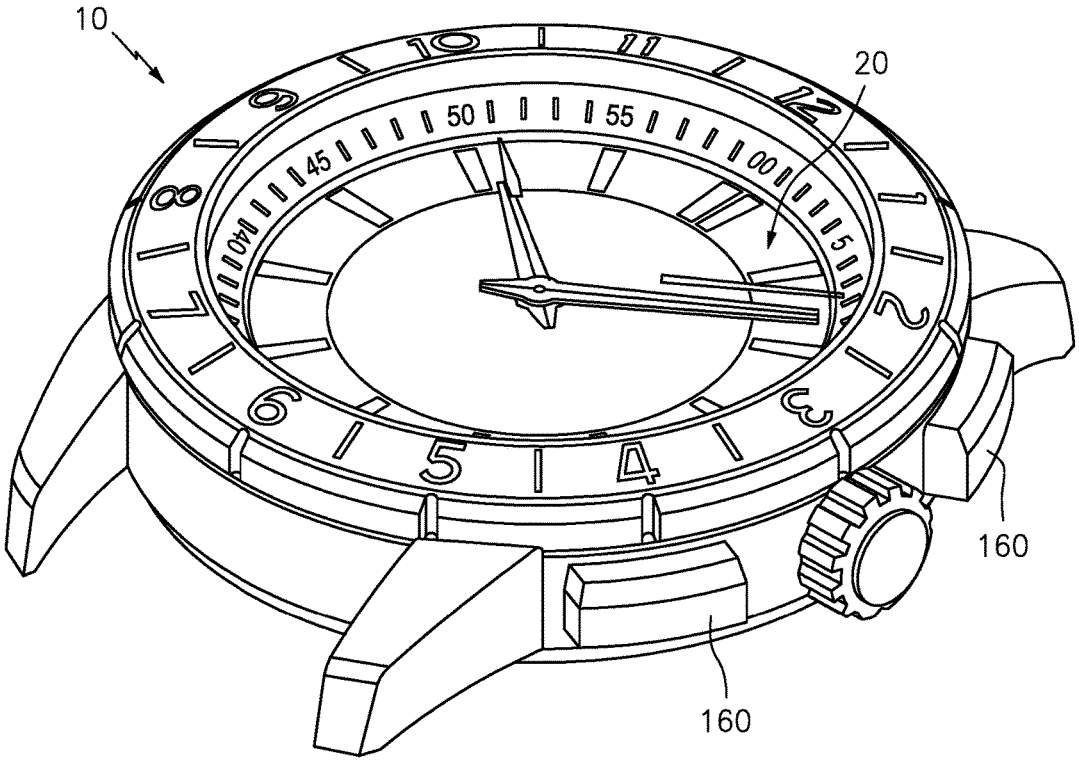
FIG. 1 illustrates a wearable electronic device in accordance with a first preferred embodiment of the present invention, wherein the digital display assembly is provided above the analog display assembly.
Figure 2:
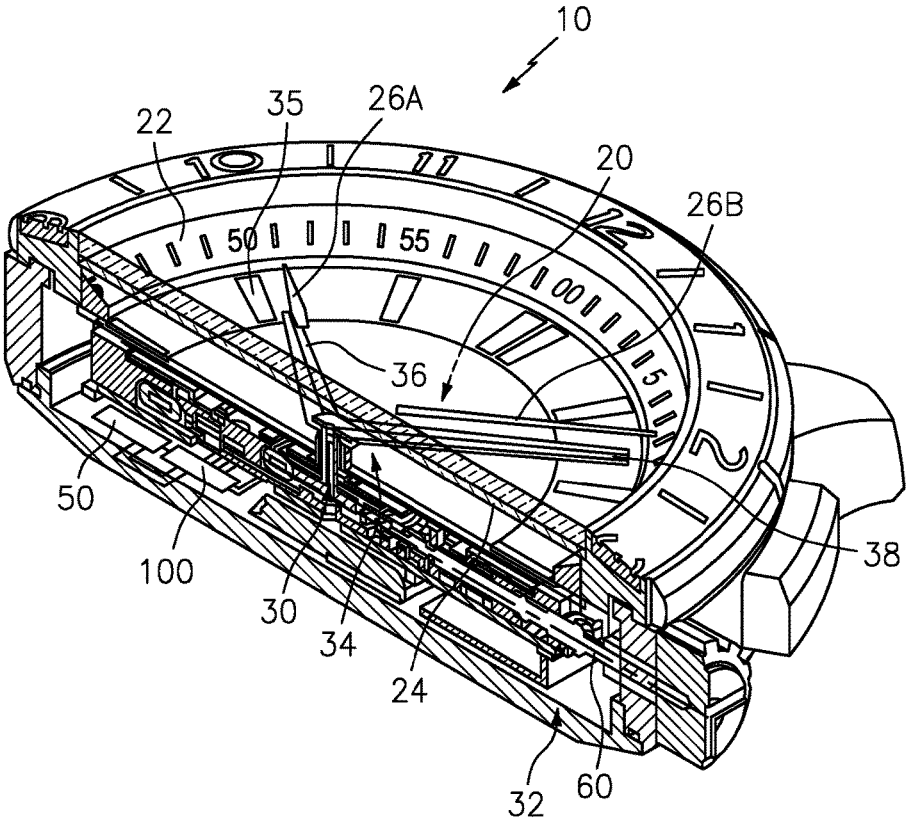
FIG. 2 is a cross sectional view of the wearable electronic device constructed in accordance with the preferred embodiment of FIG. 1.
Figure 8:
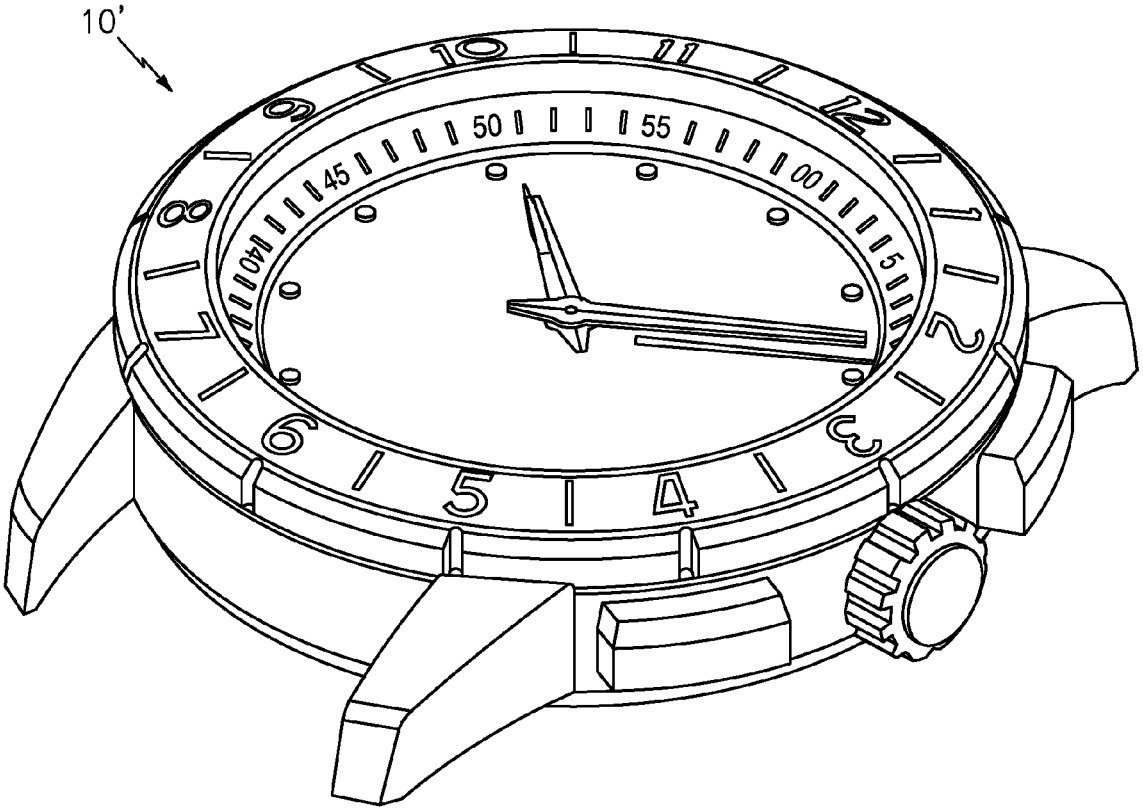
FIG. 8 illustrates a wearable electronic device in accordance with another preferred embodiment of the present invention, wherein the digital display assembly is provided below the analog display assembly.
Figure 9:
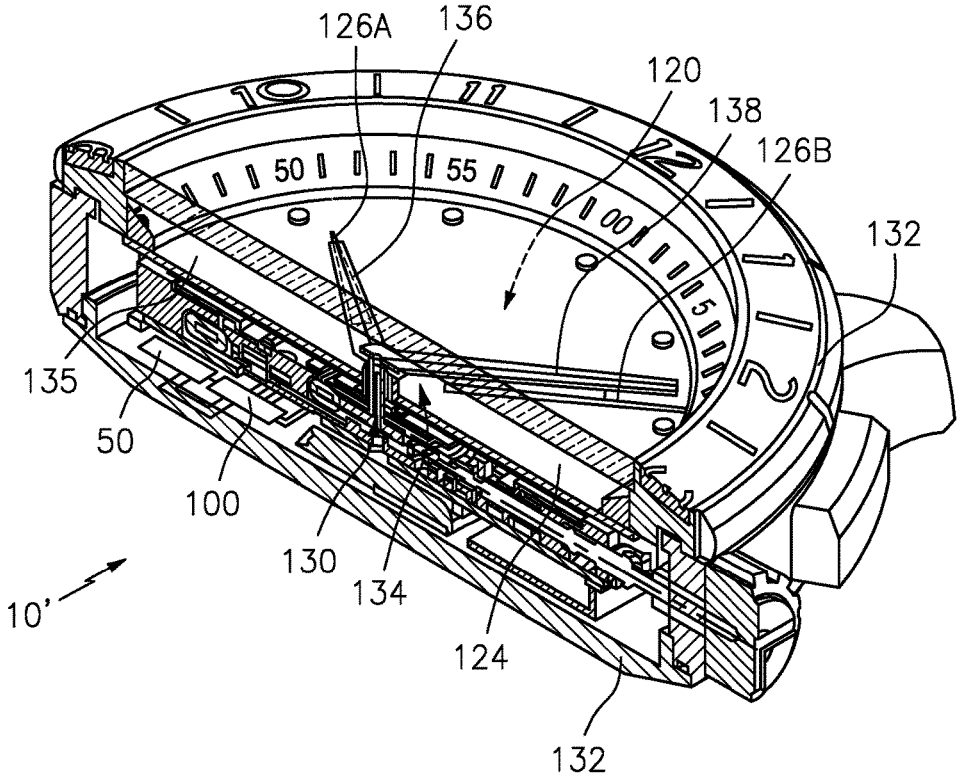
FIG. 9 is a cross sectional view of the wearable electronic device constructed in accordance with the preferred embodiment of FIG. 8.

It should first be understood that FIG. 1-2 are somewhat particular to a first preferred general embodiment of the present invention, in which the wearable electronic device comprises a digital display assembly provided above the analog display assembly. FIGS. 8-9 are somewhat particular to a preferred general embodiment of the present invention in which the digital display assembly is provided below the analog display assembly. FIGS. 3-7 illustrate features, functionality and constructions that are common to all embodiments disclosed herein, while FIGS. 8-13 show features of methodologies also common to all embodiments herein.

Reference will first be made to FIGS. 1 and 2, which illustrate a wearable electronic device, generally indicated at 10, constructed in accordance with a first embodiment of the present invention, in which the digital display assembly is provided above the analog display assembly. In accordance with this embodiment, electronic display 10 comprises a digital display assembly, indicated generally at 20, comprising a digital display 24, which is preferably of the LCD or OLED type, by way of example and not limitation. An analog display assembly, generally indicated at 30, is provided in a case or housing 32. An analog display, generally indicated at 34, is part of analog display assembly 30. Analog display 34 of the present invention is part of a watch of the aforementioned first type, i.e. generally of the quartz analog type watch, but this is by way of example and not limitation.

In the embodiment where digital display assembly 20 resides above the analog display 34, it is both desirable and possible to provide for the easy displaying of time information using the analog display while also being able to switch on and off the digital display at desired times for hand synchronization in accordance with the present invention. It is believed that the functionality of providing a digital display that provides the viewer the ability to see through the digital display assembly 20 to an analog display is described in U.S. Pat. No. 6,671,231, the subject matter of which is incorporated by reference as if fully set forth herein. However, for the convenience of the reader, the following is set forth.

With reference to FIG. 2, digital display assembly 20 comprises digital display 24 intermediate analog display 34 and a crystal 22. In a preferred embodiment, digital display 24 preferably covers the whole of the surface of a dial 35 of the analog display 34. Digital display assembly 20 is arranged so that digital display 24 may be transparent in a first switching state to make the time information displayed by analog display assembly 30, i.e. hands 36, 38 visible. On the other hand, digital display assembly 20 is arranged so that digital display 24 can also display one or more digital indicators (e.g. digital hour and/or minute hands 26A, 26B) in a second switching state, while still permitting the display of the analog display. Optionally, the digital display may also be configured to permit the complete blocking of the display of the analog display if desirable, although this latter state is not material to the present invention.

Switching digital display 24 between the first state to the second state where the digital hands may be visible while the analog display underneath remains visible (and vice versa among the states) is achieved by a microcontroller, generally indicated at 100, with the operational coupling to digital display 24 being achieved by conventional connectors to supply it with appropriate control voltage(s) and signaling.

According to an exemplary embodiment of the present invention, digital display 24 may be a twisted nematic type liquid crystal cell. Digital display assembly 20 may also include a transparent front substrate, a transparent back substrate, and a sealing frame and a closed cavity in which there is a layer of liquid crystals. For example, opposite faces of substrates may include transparent electrodes made for example of indium/tin oxide. It goes without saying that digital display 24 may be of another type provided that in a first switching state, digital display 24 is transparent, and that in a second switching state, the hands 26A, 26B of the digital display 24 is opaque and reflective or diffusing. It is well known in the art how to program and arrange for microcontroller 100 to control the display of digital time on digital display 24. Again, a further state wherein the digital display 24 completely blocks the display of the analog display would thus also be known to those skilled in the art.

In preferred embodiments of the present invention, the hand synchronization feature is carried out with respect to time information (e.g. "time of day"), but other time information may be displayed by the digital display 24, and thus hand synchronization thereof by the constructions and methodologies set forth herein is equally applicable. In addition, heartrate, moonphase and altitude indications, or other types of information displayable on digital display 24, may also be provided herein, with thus functionality achievable to synchronize the indicators (e.g. hands) of the analog display 34 to the actual or current value or indicia being shown on the digital display.

Regarding the analog display assembly 30, the construction thereof should also be known to those skilled in the art. For example, a preferred construction of analog display assembly 30, including analog display 34, is disclosed in U.S. Pat. No. 7,113,450, entitled "Wearable Electronic Device With Multiple Display Functionality," the subject matter of which is also incorporated by reference as fully set forth herein. Therefore, the present disclosure omits, for purposes of brevity, certain basic and very well-known concepts regarding the construction of analog timepieces. For example, the basic construction and arrangements of gears and/or gear trains to rotate a plurality of "standard" hands all supported on a center stem, such as an hour hand and a minute hand, are omitted as being well within the purview of one skilled in the art.

Figure 3:
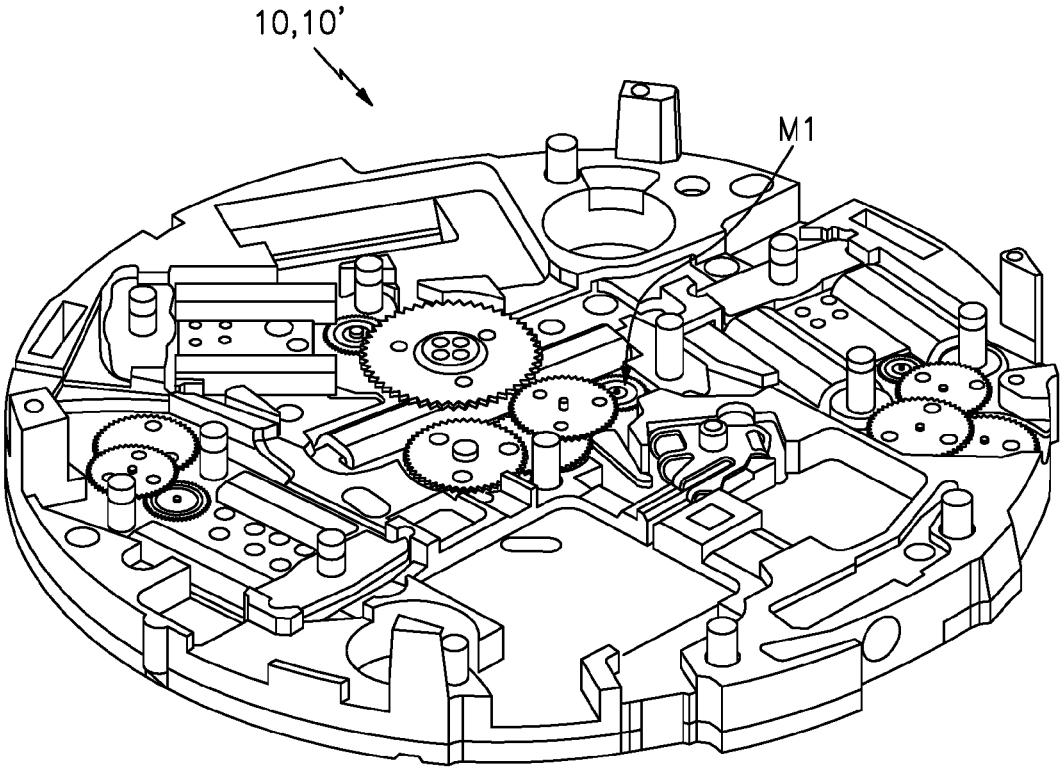
FIG. 3 is a perspective view of exemplary gearing and motors in a movement assembly for a wearable electronic device constructed in accordance with all the embodiments disclosed herein.
Figure 4:
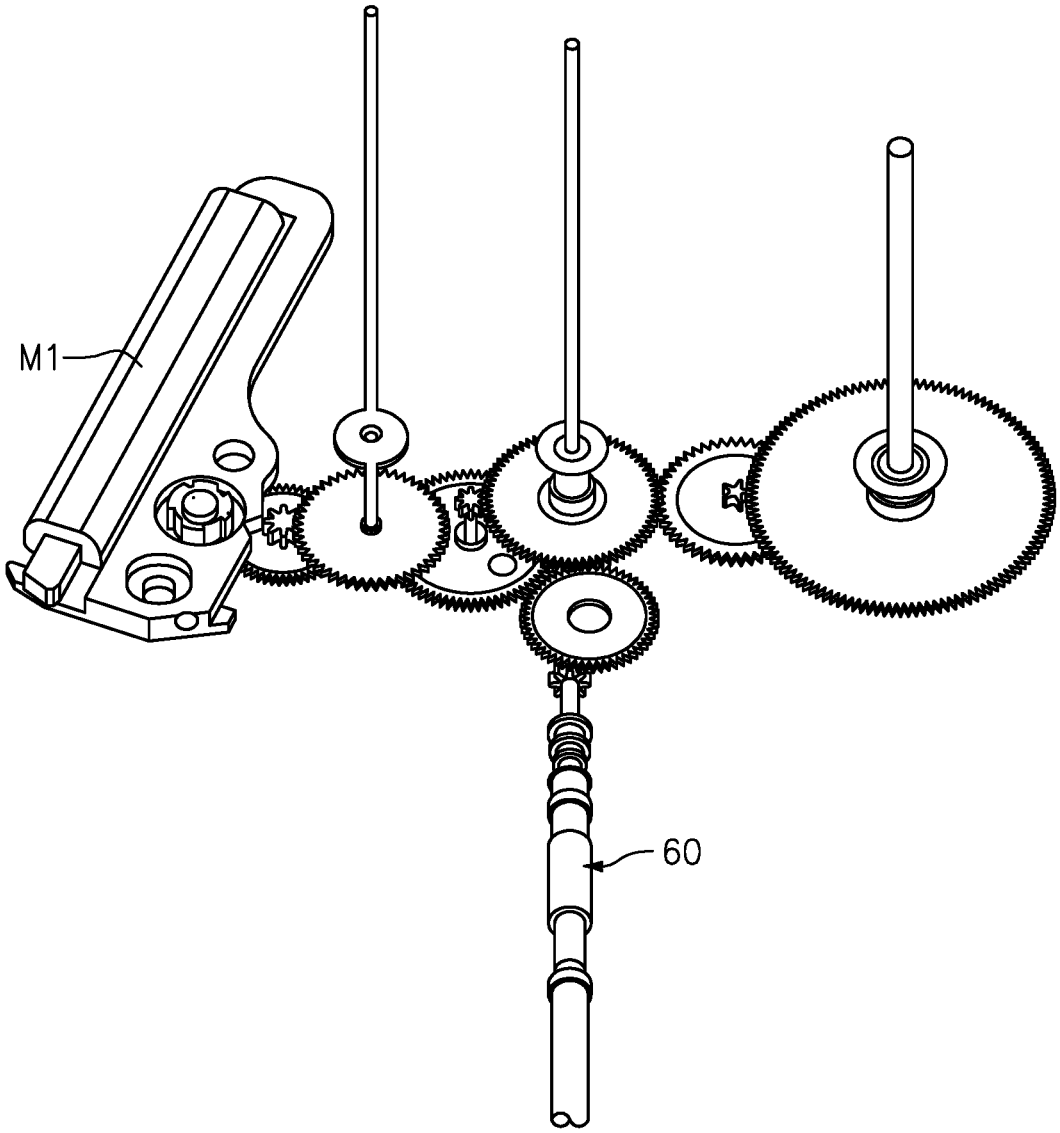
FIG. 4 shows an exemplary actuation mechanism and gear assembly for rotating analog time indicators, said exemplary actuation mechanism and gear assembly being applicable to all embodiments herein, and wherein the gear assembly is illustrated in a linear fashion, but those skilled in the art would clearly know how such an assembly would be formatted so as to create the display of e.g., FIGS. 1 and 8.

However, for completion, the following is set forth for the convenience of the reader. In order to carry out all the functionality set forth and/or contemplated herein, wearable electronic device 10 may be provided with one or more subassemblies, each of which may comprise at least one actuation mechanism and one or more gears rotatably engaged with the actuation mechanism, wherein actuation of the actuation mechanism causes the rotation of the one or more gears. As illustrated in the figures, the preferred actuation mechanisms are stepper motors. As would be understood, rotation of only a minute hand and an hour hand requires only one stepper motor (e.g. M1). The figures illustrate additional motors simply as a matter of design choice, and which may be used to rotate additional indicators, hands, rings or the like. As would also be understood in the art, the specific location of such motor(s) is one of design choice and dictated by constraints such as spacing, power and torque requirements and the desired positioning of the display hands and/or rings, as the case may be. As positioned, the respective motors rotate respective pinions as would be understood in the art. It should thus now be understood that as exemplary illustrated herein, motor M1 is provided to rotate at least hour hand 36 and minute hand 38 in a known manner. FIGS. 3, 4 also operate to illustrate a gear train to convey the rotational activity generated by the rotor of motor M1 to hands 36, 38, the configuration of FIG. 4 being understood by those skilled in the art. It should be also understood that hands 36, 38 could be rotated individually by separate motors, e.g. M1 and M2, respectively, if desired.

Figure 5:
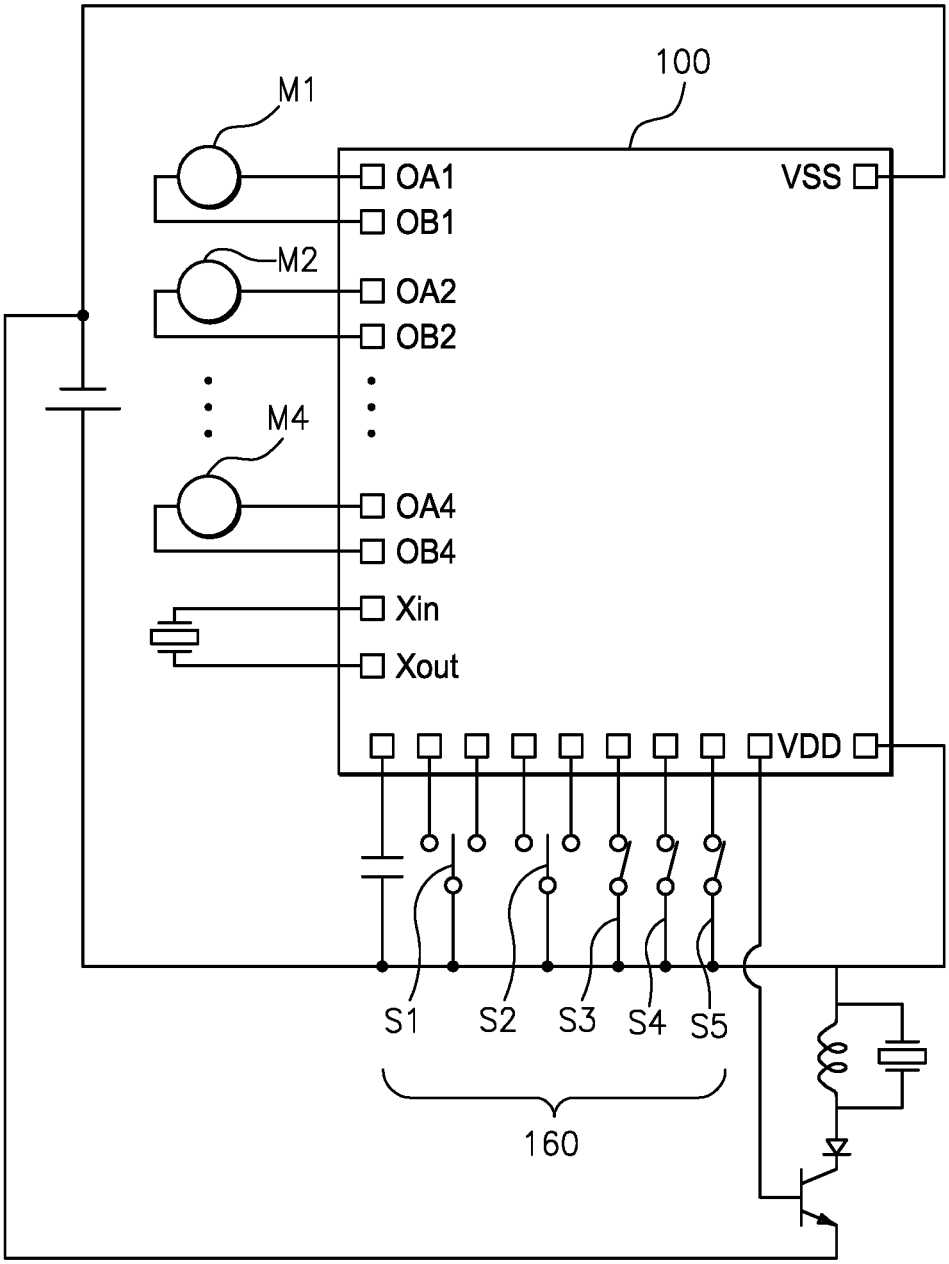
FIGS. 5-7 are block diagrams showing among other things, a controller for use in wearable electronic devices constructed in accordance with all the preferred embodiments of the present invention.
Figure 6:
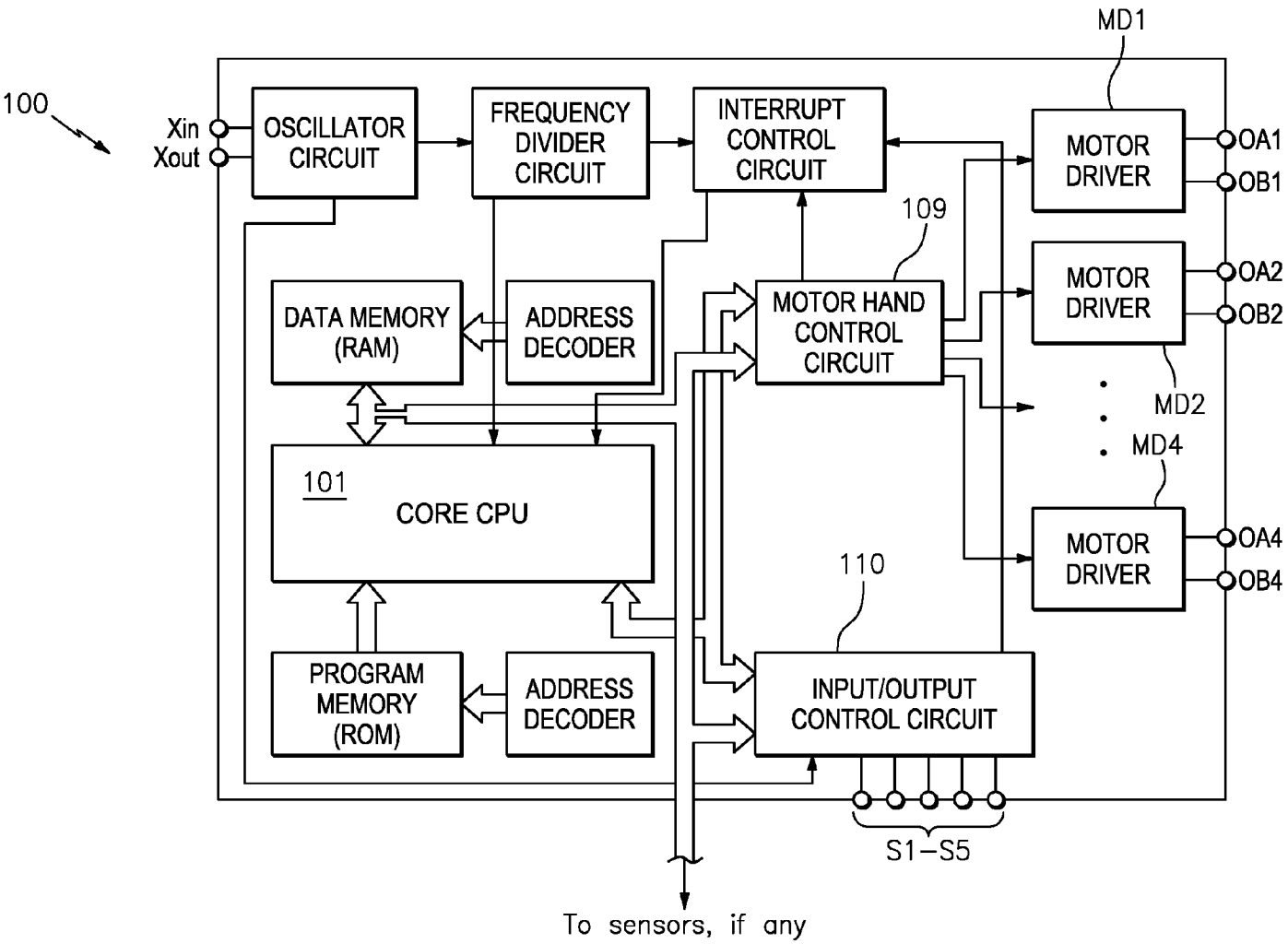
Figure 7:
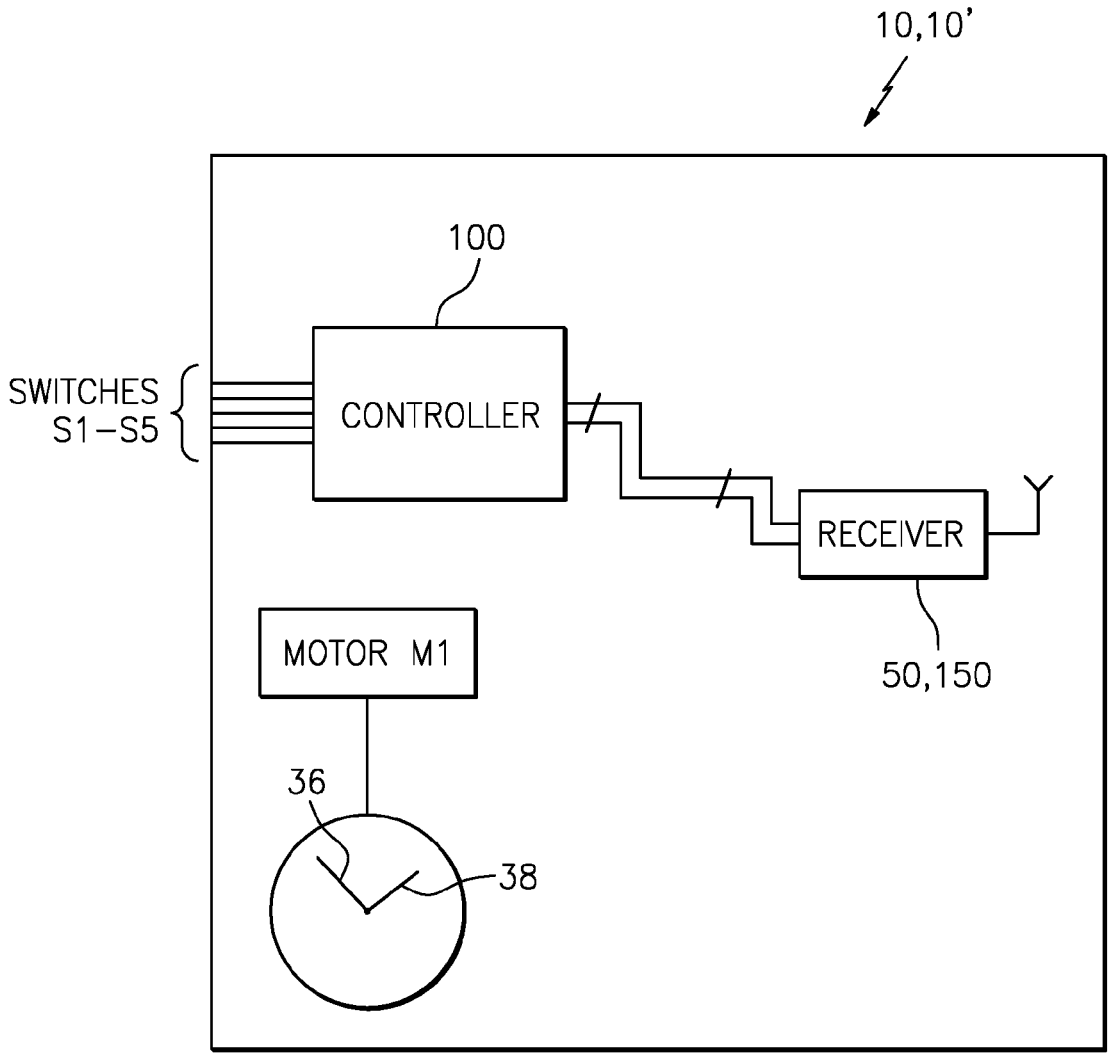

FIGS. 5-7 illustrate many additional features in accordance with the present invention, including details of microcontroller 100 for providing the proper and accurate controlling, positioning and rotation of the one or more analog display hands. Many details of microcontroller 100 can be found in the aforementioned U.S. Pat. No. 7,113,450 by reference to controller 100, and the microcontroller 100 of the present invention preferably comprises all of the functional features described therein to carry out the objectives and features of the present invention. Added functionality particular to the present invention is also disclosed herein.

For example, FIGS. 5-7 illustrate among other things, interface connections to motor M1, additional motors (e.g. M2, M3 and M4) and pushers, which are illustrated schematically as switches S1-S5. However, it is understood that the switches are also intended to generically indicate both side/top mounted pushers 160, as well as side mounted rotatable crowns, and thus respond to the actuation (i.e. pulling and/or pushing) action thereof.

FIGS. 6 and 7 illustrate block diagrams, including of microcontroller 100. Particular reference is made to motor control circuit 109, which receives a commanded "next number of pulses" from CPU core 101 and generates the pulsed and phased signals necessary to move a desired motor (e.g. MD a desired amount and in a desired direction. Pulse outputs of motor control circuit 109 are buffered by motor drivers MD1-MD4 and applied to the respective motors M1, M2, M3, M4, as the case may be. An input/output control circuit 110 can controls any crown/stem actuations and/or pushbutton switches S1-S5 and provides such signaling information to CPU 101.

As would be understood in the art and exemplary shown in the figures, the actuation mechanism(s) (e.g. stepper motor M1, M2, M3 and/or M4) comprises a rotor, and is/are operatively coupled to microcontroller 100, wherein the stepper motor steps in at least one of a clockwise and counterclockwise direction in predefined increments in response to commands from the microcontroller 100, wherein the rotor of the stepper motor is operatively coupled to the at least one analog time indicator, and wherein the rotation of rotor causes the rotation of the at least one analog time indicator in at least one of the clockwise and counterclockwise directions and in the predefined increments.

In a preferred embodiment, wearable electronic device 10 further comprises a receiver 50 for receiving, from a remote source, current time information data representative of a current time. In contemplated embodiments, the remote source may be one or more of the following: cell towers, cellphones, base stations or satellites, by way of example and not limitation. Receiver 50 receives such time information data from one or more of such remote sources in a manner that would be understood by those skilled in the art, and similar if not exactly as such time information data is received by smartphones or the like.

Wearable electronic device 10 also provides that microcontroller 100 is operatively coupled to receiver 50. Microcontroller 100 processes the current time information data received from the remote source and provides for the current time information data to be displayed by the one or more digital indicators 26A, 26B on the digital display 24 as the current time (e.g. actual time in the geographical location in which device 10 is located).

Wearable electronic device 10 also comprises an indicator rotating arrangement for causing the rotation of the at least one analog time indicator (e.g. hand 36 and/or 38) until the at least one analog time indicator is aligned with the at least one digital indicator 26A and/or 26B. In this way, the alignment of the at least one analog time indicator (e.g. hand 36 and/or 38) with the at least one digital indicator indicates that the at least one analog time indicator has been synchronized and is indicating correct time.

In one preferred embodiment, the indicator rotating arrangement comprises a rotating stem 60 and one or more rotating gears, as illustrated generally in FIG. 4 in a linear view but which is understandable by those skilled in the art, which are operatively coupled to rotating stem 60 and the at least one analog time indicator (e.g. hand 36 and/or 38). In this way, the rotation of the stem 60 causes the rotation of hand 36 and/or 38. The indicator rotating arrangement of this specific embodiment would be achieved by mechanically pulling out the stem 60 which thus operatively disengages hands 36 and/or 38 from microcontroller 100.

In another preferred embodiment, the indicator rotating arrangement utilizes both the actuation mechanism (e.g. stepper motor M1) and a setting mechanism, such as pushers or features of a rotating stem assembly, also operatively coupled to the controller 100, wherein the actuation of the setting mechanism can produce first electrical pulses and second electrical pulses, wherein said first and second electrical pulses are received by the microcontroller 100 which in turn causes the actuation mechanism to rotate the at least one analog time indicator clockwise or counterclockwise in response to said first and second electrical pulses. Such can be achieved using pushers 160 (see FIGS. 1, 5). Alternatively, using a rotating stem and rotating it in a first direction can produce first electrical pulses and rotation in an opposite direction can produce second electrical pulses, wherein said first and second electrical pulses are received by the microcontroller 100 which in turn causes the actuation mechanism to rotate the at least one analog time indicator clockwise or counterclockwise in response to said first and second electrical pulses. A rotating stem assembly that may be utilized for this specific embodiment can be found in U.S. Pat. No. 6,203,190, the subject matter of which is hereby incorporated by reference as if fully set forth herein.

In yet an alternative preferred embodiment, wearable electronic device 10 may, but need not, comprise a receiver as disclosed above. Rather, controller 100 may itself maintain the current time information and provide for the current time information to be displayed by the digital indicators on the digital display as the current time. Nevertheless, like the aforementioned embodiments, such a device 10 will provide that the indicator rotating arrangement will similarly cause the rotation of the at least one analog time indicator until the analog time indicator is aligned with the digital indicator. Thus, and in a similar manner, the alignment of the at least one analog time indicator with the digital indicator indicates that the at least one analog time indicator is indicating correct time information.

That is, in these alternative preferred embodiments, the indicator rotating arrangements may likewise comprise a rotating stem 60 and one or more rotating gears that are likewise operatively coupled to the rotating stem as set forth above and exemplary shown in FIG. 4. Alternatively (or in addition), the indicator rotating arrangement may utilize the combination of the functionality of the actuation mechanism and the setting mechanism, which similarly may comprise one or more pushers or a rotating stem assembly as set forth above.

Reference is next made to first made to FIGS. 8-9 which are directed to a wearable electronic device constructed in accordance other preferred embodiments of the present invention. For example, FIGS. 8 and 9, illustrate a wearable electronic device, generally indicated at 10', constructed in accordance with another preferred embodiment of the present invention, in which the digital display assembly is provided below the analog display assembly.

In accordance with this embodiment, electronic display 10' comprises a digital display assembly, indicated generally at 120, comprising a digital display 124, which is preferably of the LCD or OLED type, by way of example and not limitation. An analog display assembly, generally indicated at 130, is provided in a case or housing 132. An analog display, generally indicated at 134, is part of analog display assembly 130. Analog display 134 of this preferred embodiment is part of a watch that is also of the aforementioned first, i.e. quartz analog, type.

In the embodiment where digital display 124 resides below the analog display 134 (e.g. hands 136, 138), it is both desirable and possible to provide for the easy displaying of time information using the analog display while also being able to switch on and off the digital display at desired times for hand synchronization in accordance with the present invention.

For example and with reference to FIG. 9, digital display assembly 120 is arranged so that in a first switching state the digital display hands 126A, 126B are not visible and in a second switching state, digital display 124 can also display one or more digital indicators (e.g. digital hour and/or minute hands 126A, 126B) in a second switching state.

Switching digital display 124 from the first state to the second state and vice versa is similarly achieved by microcontroller 100, likewise with the operational coupling to digital display 124 being achieved by conventional connectors to supply it with appropriate control voltage(s) and signaling.

Digital display 124 may likewise comprise a liquid crystal display cell of the diffusing or reflective type in the second switching state. According to an exemplary embodiment of this embodiment, digital display 124 may likewise be a twisted nematic type liquid crystal cell. It similarly goes without saying that digital display 124 may be of another type provided that in a first switching state, the digital indicators of digital display 124 are not visible through dial 135, and in a second switching state, the digital indicators 126A, 126B of digital display 124 are visible through dial 135. Here too, it is well known in the art how to program and arrange for microcontroller 100 to control the display of digital time on digital display 124.

In yet still an alternative embodiment, the dial itself in FIGS. 8 and 9 may be the digital display, so that when the at least one analog time indicator is aligned with the at least one digital indicator the at least one analog time indicator appears superimposed on the at least one digital indicator. In the case of the embodiment of FIG. 8, digital display 124 is the dial 135.

In the embodiment of electronic device 10', analog display assembly 130 is constructed similarly to that of analog display assembly 30. Similarly, microcontroller 100 is the same for that of electronic device 10', as is the functionality of the gears, motors, and the like. Thus, it should be understood that the features of FIGS. 3-7 are likewise applicable for this embodiment of device 10'.

Wearable electronic device 10' may likewise comprise a receiver 150 that operates, constructed and functions identically to receiver 50. Microcontroller 100 is also operatively coupled to receiver 150 in the same way. And finally, wearable electronic device 10' preferably comprises at least one of the multiple indicator rotating arrangements as disclosed above with respect to device 10. That is, wearable electronic device 10' may comprise rotating stem 60 and the same rotating gears operatively coupled to rotating stem 60 as set forth above, and/or likewise may comprise the combination of an actuation mechanism(s) (e.g. stepper motor M1 and/or M2) and setting mechanism, such as pushers or features of a rotating stein assembly, as also set forth above. And finally, wearable electronic device 10' may alternatively provide that the microcontroller 100 itself maintain the current time information and provide for the current time to be displayed by the digital indicators on the digital display as the current time, all as set forth above.

Operation of the present invention will now be disclosed with reference to FIGS. 10-13, which respectively illustrate functionality and features of the present invention.

Figure 10:
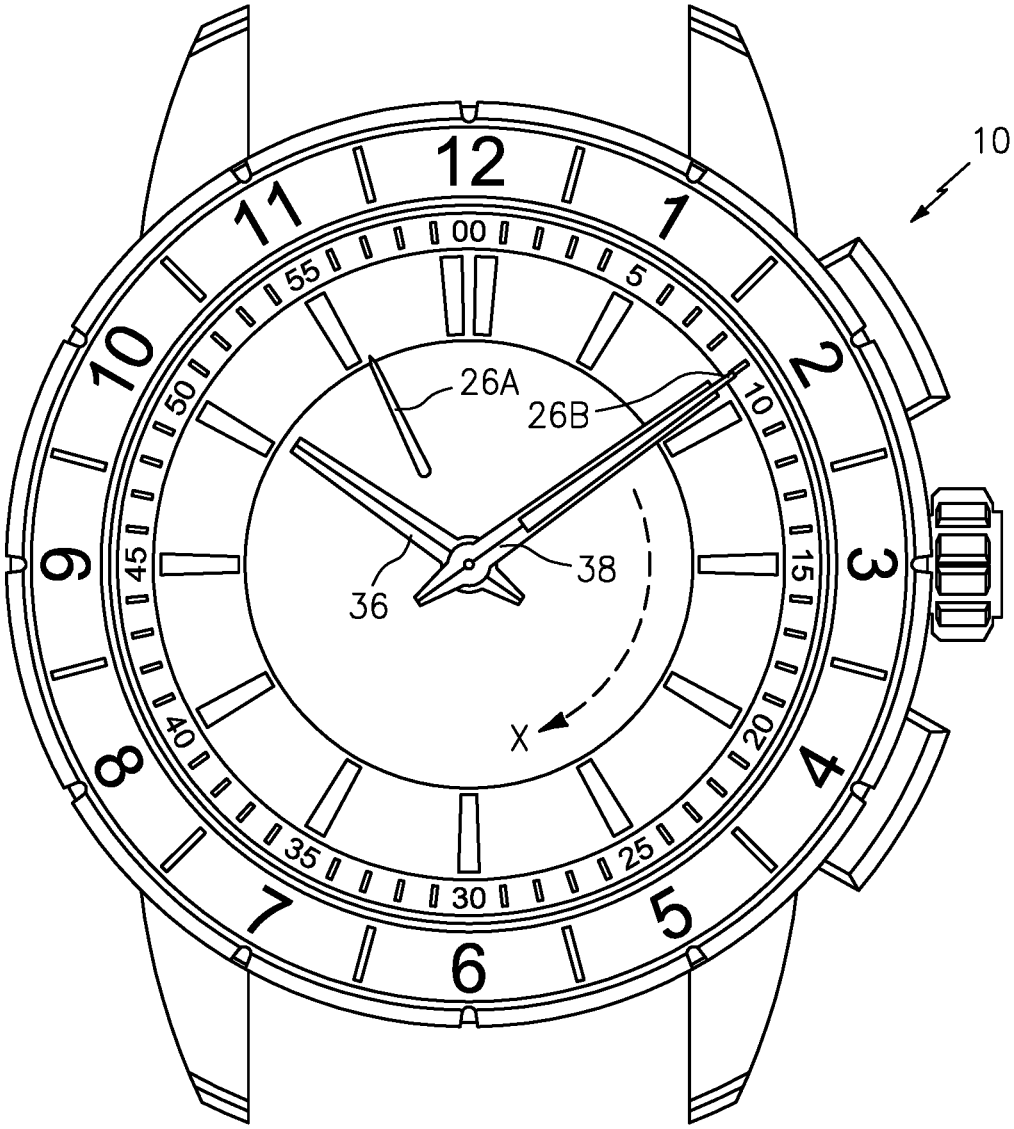
FIGS. 10-13 illustrate wearable electronic devices constructed in accordance with all the embodiments of the present invention showing a sequence of steps to carry out the hand synchronization functionality and methodology disclosed herein with FIGS. 10, 12 representing the wearable electronic device as illustrated in FIGS. 1, 2 while FIGS. 11, 13 representing the wearable electronic device as illustrated in FIGS. 8, 9.
Figure 11:
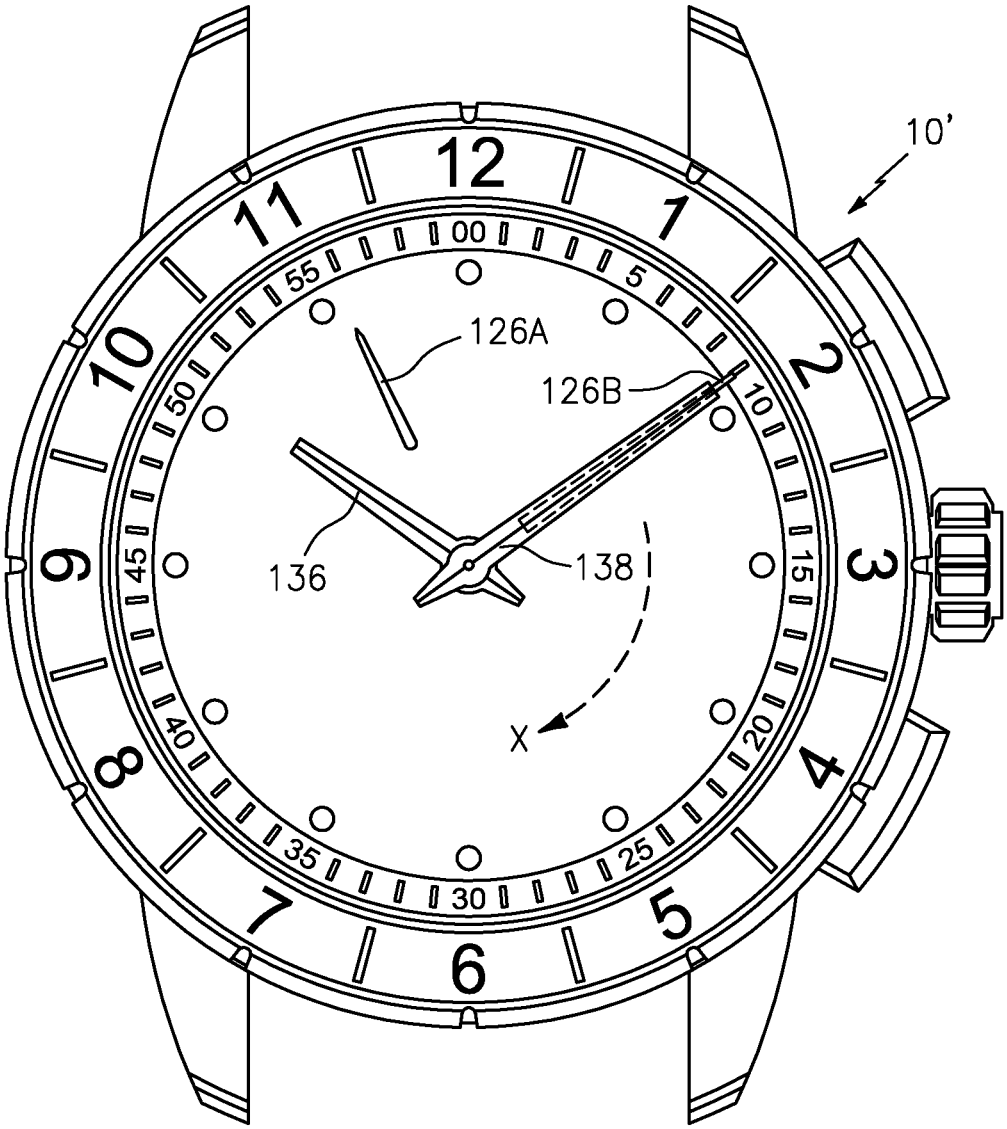
Figure 12:
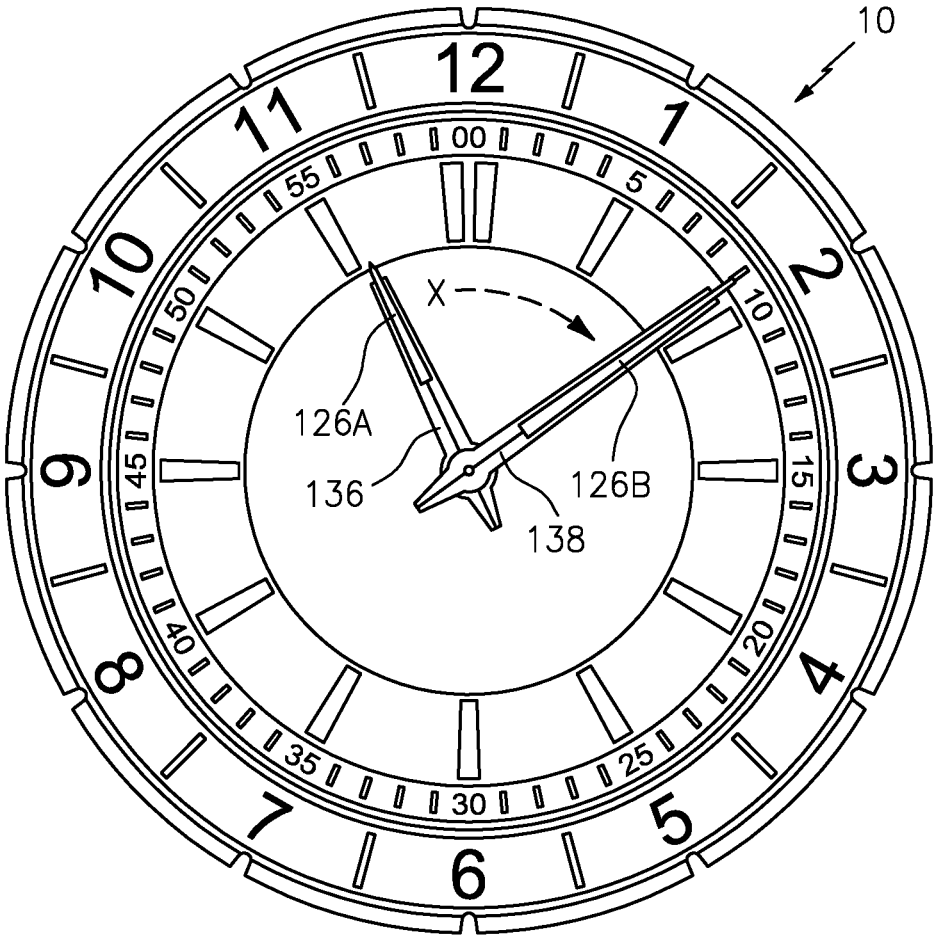
Figure 13:
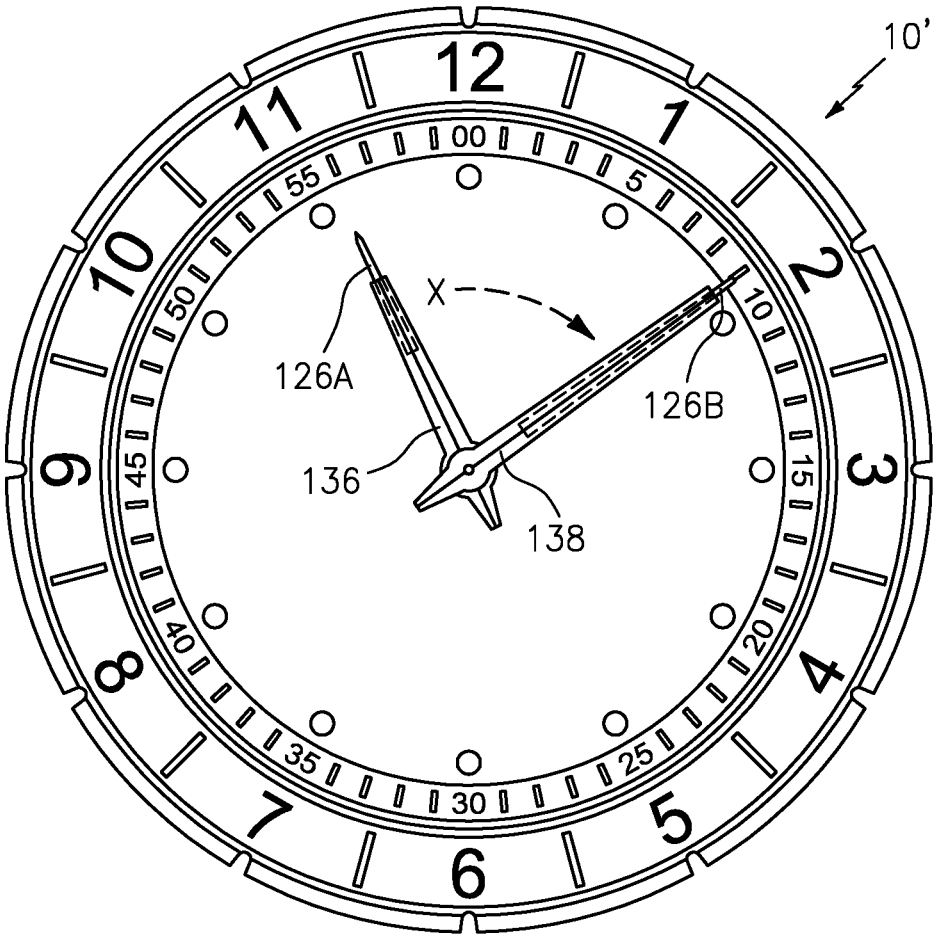
Figure 14:
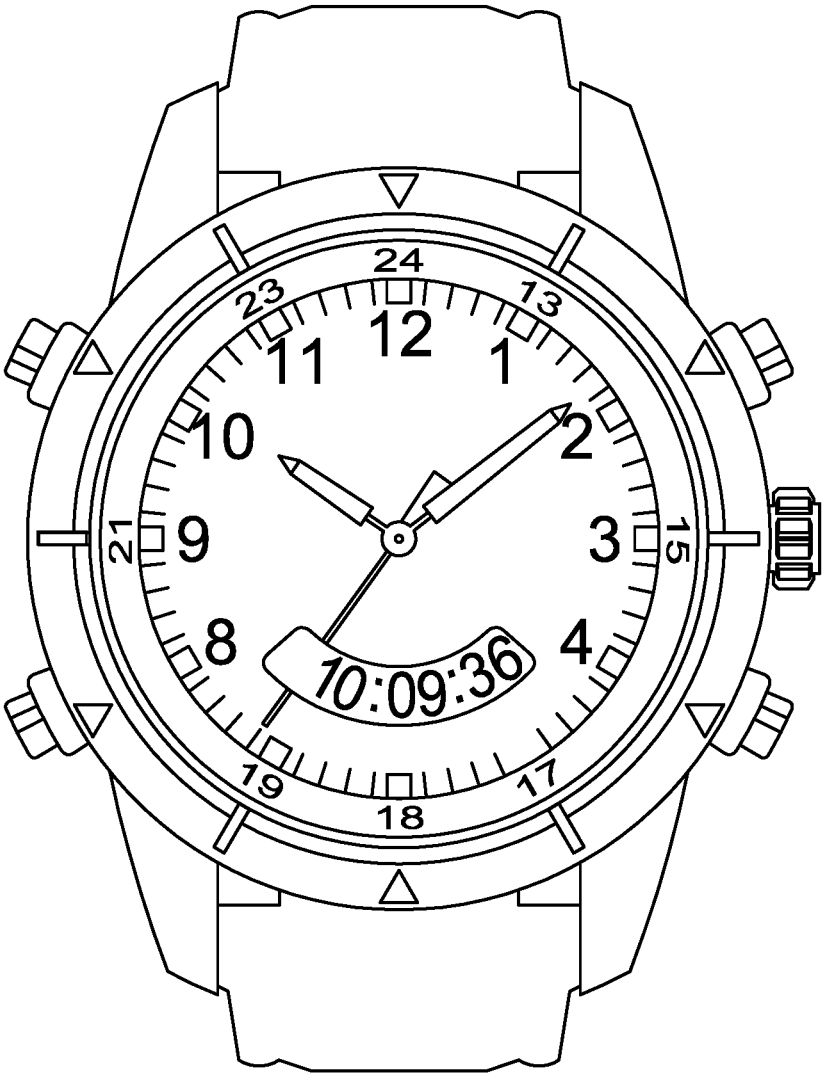
FIG. 14 (PRIOR ART)
FIG. 14 is an example of a combination analog and digital watch of the prior art.

More specifically, FIG. 10 illustrates wearable electronic device 10 having illuminated its digital indicators 26A, 26B, which will display current time based on signals device 10 has received via receiver 50 or via microcontroller 100 itself. Similarly, FIG. 11 illustrates wearable electronic device 10' having illuminated its digital indicators 126A, 126B, which display current time based on signals device 10' has received via its receiver 150 or via microcontroller 100 itself.

For purposes of explaining the present invention, it is assumed that the "correct time" is 11:09. It can further be seen in the example of FIGS. 10 and 11 that the respective analog hands 36, 38 (136, 138) are displaying 10:09. Such can be the result of many reasons, such as, the device 10, 10' entering a new time zone, a user having previously manually adjusted the hands 36, 38 (136, 138) as discussed above, or a change of the battery that caused the displayed time to be stopped, to name just a few.

However, with the indicating indicator rotating arrangements of the present invention, whether in the form of the rotating stem causing disengagement with the gearing assembly for manual setting or by using the setting mechanism embodiments disclosed above in the form of pushers or an pulse generating type rotating stem, the user can now easily and accurately adjust the analog hands 36, 38 (136, 138) to align (i.e. to synchronize) with the digital indicator hands, as shown moving from FIGS. 10, 11 to FIGS. 12, 13 respectively, by reference to the arrow "X" in each of the figures depicting rotation of the analog hands. In this way, the analog hands will be synchronized to the correct time.

In the preferred embodiments, the motors may be bi-directional stepper motors as appropriate, thus being able to rotate in either direction, and the construction of acceptable stepper motors to functionally operate in this manner are widely available and well within the understanding of those skilled in the art. Suitable dials are also well within the purview of the skilled artisan. One skilled in the art would recognize that varying the number of display hands can vary the number of needed stepper motors, all of which is within the scope of the present invention and disclosure and disclosed in those applications incorporated by reference herein.

Although the preferred embodiments provide that microcontroller 100 is highly integrated wherein all timing and display functionality is controlled by microcontroller 100, alternate embodiments could separate the timekeeping functions from those processing and other functionality, as would be understood by one skilled in the art.

As should also be appreciated by one skilled in the art, the location, position and/or size of the display indicators and/or display hands are merely dictated, for example, by the position of pinions and the position of the respective sub-assemblies and thus the illustrations herein are shown by example and not limitation.

The gearing ratio to provide for the desirable display rotation or movement of the display hands would be one of design choice depending on the desired or required incremental rotation of the display indicator. Thus the number of wheels in any particular gearing assembly may be more or less than that disclosed herein, and are really one of design choice for the intended function and based upon a number of criterions known to the ordinary designer.

It can thus be seen that the present invention provides for an improved method and construction for synchronizing the analog indicator hands in a wearable electronic device, preferably of the quartz analog type, and the present invention provides an improved user interface therefor that is easy to use and which should be welcome to the user over any type of hand synchronization arrangements in the prior art.

As alluded to above, the present invention is applicable for synchronizing a wide range of parameters, not just conventional time information. As alluded to above, heart-rate, moonphase and altitude indications are just some of the information that may be synchronized by the invention disclosed herein on the device. As such, the present invention is also applicable to a wearable electronic device comprising (i) an analog display for the display of information by at least one analog time indicator and (ii) a digital display having at least one digital indicator for displaying at least accurate and/or current information on the digital display, a receiver for receiving, from a remote source, at least accurate and/or current information data representative of current and/or accurate information; a controller, operatively coupled to the receiver, wherein the controller processes the current and/or accurate information data received from the remote source and provides for the current and/or accurate information data to be displayed by the at least one digital indicator on the digital display as the current and/or accurate information; an analog indicator rotating arrangement for causing the rotation of the at least one analog indicator until the at least one analog indicator is aligned with the at least one digital indicator; whereby the alignment of the at least one analog indicator with the at least one digital indicator indicates that the at least one analog indicator is synchronized with the current and/or accurate information.

In yet another embodiment therefor, the wearable electronic device may comprise (i) an analog display for the display of information by at least one analog indicator and (ii) a digital display having at least one digital indicator for displaying at least accurate and/or current information on the digital display; a controller, wherein the controller maintains accurate and/or current information and provides for the accurate and/or current information to be displayed by the at least one digital indicator on the digital display as the accurate and/or current information; an analog indicator rotating arrangement for causing the rotation of the at least one analog indicator until the at least one analog indicator is aligned with the at least one digital indicator; whereby the alignment of the at least one analog indicator with the at least one digital indicator indicates that the at least one analog indicator is synchronized with the accurate and/or current information.

In such additional embodiments, the analog indicators are envisioned to include rings, hands, moon images or other mechanical indicators that might not be the traditional hands disclosed and illustrated above. Corresponding digital indicators could likewise be easily configured. As such, the present invention easily lends itself to the accurate and/or current synchronization of such information (e.g. parameters) as blood pressure, heartrate, altitude and/or moonphases as discussed here and/or other time information such as dates, days or other displayable time related parameters.

Therefore, the drawings provided herein are equally applicable to the foregoing additional embodiments. For example, in connection with displays applicable to heartrate and/or altitude, only the surface indicia on the dial or bezel needs to be changed to accommodate the scale or parameter being displayed, with the underlying functionality of the displaying of such parameters being understood by one of ordinary skill in the art, such as from a reading of the aforementioned U.S. Pat. No. 7,113,450. For example, even the surface indicia of the dials/bezels of FIGS. 10-13 as currently presented should be understood to cover such embodiments. With a display of moon phase, similarly, hands or other rings could be used, such as that disclosed in U.S. application Ser. No. 13/782,047 the figures of which are incorporated by reference as if fully set forth herein. Providing a digital representation of such displays, in order to achieve the functionality, advantages and objectives of the present invention, are likewise well within the purview of one skilled in the art. In this way, the analog display indicators (e.g. 36, 38) could be substituted by the display indicators in application Ser. No. 13/782,047 and the digital representation of indicators 26A, 26B could likewise be substituted with digital representations thereof.

The other features, options and functionality disclosed above with respect to the embodiments of FIGS. 1-13 are equally applicable to the embodiments set forth above with respect to information that may not be "time of day."

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall therebetween.

To be sure, the present invention is applicable to a wide variety of devices and applications. That is, while the following embodiments have been disclosed with reference to quartz analog watches, the scope of the invention is not so limiting.

What is claimed is:

1. A wearable electronic device comprising (i) an analog display for the display of time information by at least one analog time indicator and (ii) a digital display having at least one electronic analog indicator for displaying at least current time on the digital display, a receiver for receiving, from a remote source, current time information data representative of a current time;

a controller, operatively coupled to the receiver, wherein the controller processes the current time information data received from the remote source and provides for the current time information data to be displayed by the at least one electronic analog indicator on the digital display as the current time;

an analog time indicator rotating arrangement for causing the rotation of the at least one analog time indicator until the at least one analog time indicator appears superimposed with the at least one electronic analog indicator;

whereby the superimposed position of the at least one analog time indicator with the at least one electronic analog indicator indicates that the at least one analog time indicator is synchronized with the current time.

2. The wearable electronic device as claimed in claim 1, wherein the analog time indicator rotating arrangement comprises a rotating stem and one or more rotating gears that are operatively coupled to (i) the rotating stem and (ii) the at least one analog time indicator, wherein the rotation of the stem causes the rotation of the at least one analog time indicator.

3. The wearable electronic device as claimed in claim 1, wherein the analog time indicator rotating arrangement comprises:

an actuation mechanism operatively coupled to the controller, wherein the actuation mechanism rotates the at least one analog time indicator clockwise or counterclockwise;

a setting mechanism operatively coupled to the controller, wherein the setting mechanism selectively produces first electrical pulses and second electrical pulses, wherein said first and second electrical pulses are received by the controller which in turn causes the actuation mechanism to rotate the at least one analog time indicator clockwise or counterclockwise in response to said first and second electrical pulses.

4. The wearable electronic device as claimed in claim 3, wherein the setting mechanism is a rotatable setting mechanism, wherein the rotation of the setting mechanism in the first direction produces the first electrical pulses and rotation of the rotating setting mechanism in the second direction produces the second electrical pulses.

5. The wearable electronic device as claimed in claim 1, wherein the digital display is positioned above the analog display, and when the at least one analog time indicator is aligned with the at least one electronic analog indicator the at least one digital indicator appears superimposed on the at least one analog time indicator.

6. The wearable electronic device as claimed in claim 1, wherein the digital display is positioned below the analog display, and when the at least one analog time indicator is aligned with the at least one electronic analog indicator the at least one analog time indicator appears superimposed on the at least one electronic analog indicator.

7. The wearable electronic device as claimed in claim 1, comprising a dial, wherein the dial itself is the digital display, and when the at least one analog time indicator is aligned with the at least one electronic analog indicator the at least one analog time indicator appears superimposed on the at least one electronic analog indicator.

8. A wearable electronic device comprising (i) an analog display for the display of time information by at least one analog time indicator and (ii) a digital display having at least one electronic analog indicator for displaying at least current time on the digital display;

a controller, wherein the controller maintains current time information and provides for the current time information to be displayed by the at least one electronic analog indicator on the digital display as the current time;

an analog time indicator rotating arrangement for causing the rotation of the at least one analog time indicator until the at least one analog time indicator appears superimposed with the at least one electronic analog indicator;

whereby the superimposed position of the at least one analog time indicator with the at least one electronic analog indicator indicates that the at least one analog time indicator is synchronized with the current time.

9. The wearable electronic device as claimed in claim 8, wherein the analog time indicator rotating arrangement comprises a rotating stem and one or more rotating gears that are operatively coupled to (i) the rotating stem and (ii) the at least one analog time indicator, wherein the rotation of the stem causes the rotation of the at least one analog time indicator.

10. The wearable electronic device as claimed in claim 8, wherein the analog time indicator rotating arrangement comprises:

an actuation mechanism operatively coupled to the controller, wherein the actuation mechanism rotates the at least one analog time indicator clockwise or counterclockwise;

a setting mechanism operatively coupled to the controller, wherein the setting mechanism selectively produces first electrical pulses and second electrical pulses, wherein said first and second electrical pulses are received by the controller which in turn causes the actuation mechanism to rotate the at least one analog time indicator clockwise or counterclockwise in response to said first and second electrical pulses.

11. The wearable electronic device as claimed in claim 10, wherein the setting mechanism is a rotatable setting mechanism, wherein the rotation of the setting mechanism in the first direction produces the first electrical pulses and rotation of the rotating setting mechanism in the second direction produces the second electrical pulses.

12. The wearable electronic device as claimed in claim 8, wherein the digital display is positioned above the analog display, and when the at least one analog time indicator is aligned with the at least one electronic analog indicator the at least one digital indicator appears superimposed on the at least one analog time indicator.

13. The wearable electronic device as claimed in claim 8, wherein the digital display is positioned below the analog display, and when the at least one analog time indicator is aligned with the at least one electronic analog indicator the at least one analog time indicator appears superimposed on the at least one electronic analog indicator.

* * * * *